US006094561A

United States Patent [19]

Ushio

[11] Patent Number: 6,094,561

[45] **Date of Patent: *Jul. 25, 2000**

[54] IMAGE FORMING APPARATUS

[75] Inventor: Kenji Ushio, Numazu, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/962,646

[22] Filed: Nov. 3, 1997

[30] Foreign Application Priority Data

Nov. 9, 1996 [JP] Japan ..... 8-310193

[51] Int. Cl.[7] ..... G03G 15/00

[52] U.S. Cl. ..... 399/401; 399/406

[58] Field of Search ..... 399/363, 364, 399/381, 397, 401, 402, 405, 406

[56] References Cited

U.S. PATENT DOCUMENTS 4,814,825 3/1989 Johdai et al. ..... 399/405 X 5,132,742 7/1992 Goto ..... 399/401

5,317,377 5/1994 Rubscha et al. ..... 399/401

5,414,503 5/1995 Siegel et al. ..... 399/406

*Primary Examiner*—Arthur T. Grimley

*Assistant Examiner*—Hoan Tran

*Attorney, Agent, or Firm*—Fitzpatrick, Cella, Harper & Scinto

[57] ABSTRACT

The present invention aims to improve productivity when a sheet is discharged while surface-reversing the sheet. When a curl removing means also acts as a convey means, excessive curl or wrinkle can be prevented from being formed in the sheet being conveyed. An image forming apparatus according to the present invention includes a first curl removing roller pair and a second curl removing roller pair (convey means/curl correcting means) which are disposed in a re-supply convey path, so that, when the sheet is surface-reversed, the first curl removing roller pair is retarded from the re-supply convey path in accordance with a length of the sheet (to be surface-reversed) in a conveying direction.

21 Claims, 8 Drawing Sheets

SENSOR ON

SENSOR ON

SENSOR OFF

SENSOR OFF

IMAGE FORMING APPARATUS

BACKGROUND OF THE INVENTION

1. Field of the Invention

The present invention relates to an image forming apparatus such as a printer, a copying machine and the like, and more particularly it relates to a technique for controlling a convey means when a sheet material on which an image was formed in an image forming portion is surface-reversed or turned over by using a re-supply convey path.

2. Related Background Art

In some conventional copying machines in which images can be formed on both surfaces of a sheet material (both-face copy), there are provided a re-supply convey path branched from a convey path at a downstream side of an image forming means disposed within a main body and connected to a portion at an upstream side of the image forming means, and an intermediate tray disposed in the re-supply convey path.

A plurality of sheet materials having one surface (first surface) on which an image was formed are temporarily stacked on the intermediate tray, and, thereafter, each sheet material is re-supplied from the intermediate tray to the image forming means through the re-supply convey path in order to form an image on the same first surface or the other surface (second surface) of the sheet material.

If the sheet material curled due to the image formation on the first surface or the fixing of the image to the first surface is rested on the intermediate tray, the poor conveyance, poor stacking of sheet materials onto the intermediate tray and/or poor sheet material re-supply will occur. Further, if the curled sheet material is re-supplied to the image forming means, image quality will be worsened or sheet material jam will occur.

To avoid the above-mentioned drawbacks, normally, a curl removing means or a curling means for curling the sheet material in an opposite direction is provided in front of the intermediate tray.

Now, a concrete construction of a conventional copying machine 101 having the above-mentioned arrangement will be briefly described with reference to FIG. 5. In FIG. 5, sheet materials S' are separated and supplied one by one from a cassette 111 by means of a pick-up roller 110, and the separated sheet material is supplied to an image forming portion 112 through a vertical convey path 109. After an image is formed on the sheet material in the image forming portion 112, the sheet material is sent to a fixing device 114, where the image is fixed to the sheet material. Thereafter, the sheet material is conveyed to a surface-reverse/discharge portion 115, where a travelling direction of the sheet material is switched in dependence upon whether the sheet material is normally discharged or both-face copy is effected regarding the sheet material.

That is to say, when the sheet material S' is normally discharged, the sheet material is conveyed through the surface-reverse/discharge portion 115 in a direction shown by the arrow A101 to be discharged onto a sheet discharge tray 116. A flapper 115*a* can be rotated to switch convey paths.

When the both-face copy is effected, the sheet material is conveyed in a direction shown by the arrow A102 to be introduced into a re-supply convey path R101 (shown by the dot and chain line in FIG. 5), where the curl formed in the sheet material is removed by a first curl removing means 120 and a second curl removing means 121. Thereafter, the sheet material is rested on an intermediate tray 122. When an image is to be formed on the second surface of the sheet material, the sheet materials stacked on the intermediate tray are separated one by one by means of a re-supply means (pick-up roller 123 and separation means 124), and the separated sheet material is passed through a lower convey portion 126 via a pair of convey rollers 125. Then, the sheet material is re-supplied, through the vertical convey path 109, to the image forming portion 112, where an image is formed on the second surface of the sheet material. Then, the sheet material is sent to the fixing device 114, where the image is fixed to the second surface of the sheet material. Thereafter, the sheet material is discharged through the surface-reverse/discharge portion 115.

The first and second curl removing means 120, 121 will be explained with reference to FIGS. 6 and 7. The first curl removing means 120 shown in FIG. 6 comprises an iron roller 120*a* and a sponge roller 120*b* arranged in such a manner that the iron roller 120*a* is penetrated into the sponge roller 120*b* to deform a part of the latter. When the sheet material S' passes through a nip between the iron roller 120*a* and the sponge roller 120*b*, the sheet material S' is urged against the iron roller 120*a* to be curled along the iron roller 120*a*, thereby removing the curl directing toward a direction opposite to the iron roller 120*a*.

The second curl removing means 121 comprises a lower roller 121*a* having a through shaft, a holder 121*b* pivotally mounted on a pivot shaft 121*c* and biased toward the lower roller 121*a*, and two rollers 121*d*, 121*e* rotatably supported by the holder 121*b*. When the sheet material S' passes through the second curl removing means, the sheet material is urged against the lower roller 121*a* by the rollers 121*d*, 121*e*, thereby curling the sheet material along the lower roller 121*a* (removing the curl directing toward a direction opposite to the lower roller 121*a*). In order to improve the stacking of the sheet materials onto the intermediate tray 122, flanges each having a height of about 0.5 mm are provided on both ends of the lower roller 121*a*, thereby enhancing sheet material discharging ability.

The copying machine 101 further includes a surface reversing function for discharging the sheet material S' onto the discharge tray 116 while surface-reversing the sheet material. The surface reversing function is required for discharging and arranging the sheet material S' in a copying sequence by surface-reversing the sheet material S' (on an upper surface of which the image was formed in the image forming portion 112) and then discharging the sheet material onto the discharge tray 116.

Explaining the surface reversing function with reference to FIG. 5, the sheet material S' to which the image was fixed is directed to the re-supply convey path R101 in the direction A102 by the flapper 115*a* of the surface-reverse/discharge portion 115. At the same time when a trail end of the sheet material S' passes through a lower end of the flapper 115*a* (this fact is detected by a sensor (not shown)), the first and second curl removing means 120, 121 are rotated reversely to convey the sheet material in an opposite or reverse direction shown by the arrow A103, thereby discharging the sheet material onto the discharge tray 116.

However, the above-mentioned conventional surface reversing mechanism utilizing the curl removing means has the following two problems.

A first problem relates to a wrinkle generated in the sheet material when the sheet material is being conveyed. More specifically, since the sheet material is conveyed in the normal and reverse directions by the curl removing rollers while pinching the sheet material between the curl removing rollers, the greater stress is applied to the sheet material than that in the case where the sheet material is conveyed by normal rollers (not removing the curl), with the result that the wrinkle is apt to be formed in the sheet material. This is true particularly when a thin sheet material having low rigidity or a large sized sheet material (which is pinched between the curl removing rollers for a long time) is conveyed.

A second problem relates to reduction of productivity of the copying machine (during the surface-reverse and discharge of the sheet material) due to the longer time for surface-reversing the sheet material, i.e., reduction of the number of sheet materials to be discharged per unit time.

Explaining this problem with reference to FIG. 8, a distance between the rollers (convey means) must be selected to be smaller than a size of a smallest sheet material to be conveyed. When it is assumed that the smallest sheet material is a statement sheet, the distance between the rollers must be smaller than 139.5 mm (length of the statement sheet). When convey means are arranged as shown in FIG. 8 in accordance with the above conditions, in a case where pairs of convey rollers 117 and 118 are disposed on both sides of the flapper 115*a*, a distance between the pair of convey rollers 117 and the first curl removing means 120 becomes 110 mm. Further, a distance between the first curl removing means 120 and the second curl removing means 121 is also selected to become smaller than the length of the statement sheet. Incidentally, a distance between the lower end of the flapper 115*a* and the first curl removing means 120 is selected to 20 mm.

With this arrangement, when a plurality of sheet materials having A4 size are surface-reversed and discharged, a first sheet material is conveyed in the normal direction until a trail end of the first sheet material leaves the lower end of the flapper 115*a* and reaches a position in front of the first curl removing means 120 by 10 mm.

When the trail end of the sheet material is detected by the sensor (not shown) at this position, the conveyance of the sheet material in the reverse direction is started, with the result that the sheet material is conveyed in the direction A103 by the first and second curl removing means 120, 121.

Accordingly, a tip end of a second sheet material must not reach the first curl removing means 120 until the trail end of the first sheet material leaves the first curl removing means 120.

Thus, the longer a distance L' (200 mm in case of A4 size sheet material) between the convey means for surface-reversing the sheet material (first curl removing means 120, in this case) and the tip end of the sheet material the longer a distance between the first and second sheet materials, with the result that the number of sheet materials discharged per unit time is decreased (reduction of productivity).

In the conventional techniques, since the arrangement of the convey means is limited by the smallest size sheet material to be conveyed, the distance L' cannot be decreased, thereby resulting in the reduction of productivity during the surface-reversing and discharging.

SUMMARY OF THE INVENTION

The present invention aims to solve the above-mentioned conventional problems, and an object of the present invention is to improve productivity when a sheet material is discharged while being surface-reversed and to maintain quality of the sheet material by preventing excessive curl and wrinkle from being generated in the sheet material when curl removing means also act as convey means.

To achieve the above object, according to the present invention, there is provided an image forming apparatus comprising an image forming portion for forming an image on a sheet material, a convey path for conveying the sheet material conveyed from the image forming portion to a discharge portion, a re-supply convey path branched from a branch portion provided in the convey path and adapted to supply the sheet material to the image forming portion again, a switching means disposed at the branch portion and adapted to switch a path through which the sheet material is conveyed to the convey path or the re-supply convey path, a plurality of convey means provided at a plurality of positions in the re-supply convey path, and a surface-reversing/discharging means for returning the sheet material entered into the re-supply convey path to the convey path by switching conveying direction of the convey means and for discharging the sheet material from the discharge portion through the convey path while surface-reversing the sheet material, and wherein some of the plurality of convey means can be retarded from the re-supply convey path to positions where the convey means do not convey the sheet material, and the surface-reversing/discharging means causes the convey means to retard from the re-supply convey path in accordance with a length of the sheet material to be surface-reversed in a conveying direction.

With this arrangement, since the sheet material is conveyed by the other convey means which are not retarded (from the re-supply convey path), deterioration of the sheet material due to the conveyance can be prevented.

It is preferable that the convey means are successively retarded from an upstream one in accordance with the length (in the conveying direction) of the sheet material to be surface-reversed, and a next sheet material is entered into the re-supply convey path at a timing that the next sheet material is overlapped with the sheet material to be conveyed in a reverse direction through the re-supply convey path, at a position where the last convey means is retarded.

With this arrangement, a sheet-to-sheet distance between the sheet materials to be surface-reversed can be reduced, thereby increasing the number of sheet materials discharged per unit time.

Further, it is preferable that the surface-reversing/discharging means makes a conveying speed of the convey means faster in the reverse direction than in the normal direction.

Also with this arrangement, the number of sheet materials discharged per unit time can be increased.

It is preferable that the convey means includes a curl correcting means for correcting curl in the sheet material being conveyed by pinching and conveying the sheet material.

The curl correcting means serve to correct the curl formed in the sheet material in the image forming portion in front of the re-supply convey path and/or in the convey path. When the sheet material is surface-reversed, since the sheet material is conveyed by engaging with only the curl correcting means which are not retarded from the re-supply convey path, unwanted curl correction and generation of a wrinkle can be prevented, thereby maintaining quality of the sheet material.

The image forming apparatus may include a curl correction amount changing means for changing a curling amount of the curl correcting means of the convey means which are not retarded, in synchronous with the retarding movement of the convey means which are retarded.

With this arrangement, the curl correction amount of the sheet material conveyed by the convey means which is not retarded is changed to maintain the quality of the sheet material.

It is preferable that the convey means which is not retarded includes a single roller and two sub-rollers urged against the roller at different positions along a circumferential direction so that the curl can be corrected by passing the sheet material through nips between the roller and the sub-rollers, and the curl correcting means can separate at least one of the sub-rollers from the roller.

DETAILED DESCRIPTION OF THE PREFERRED EMBODIMENTS (First Embodiment)

Figure 1:
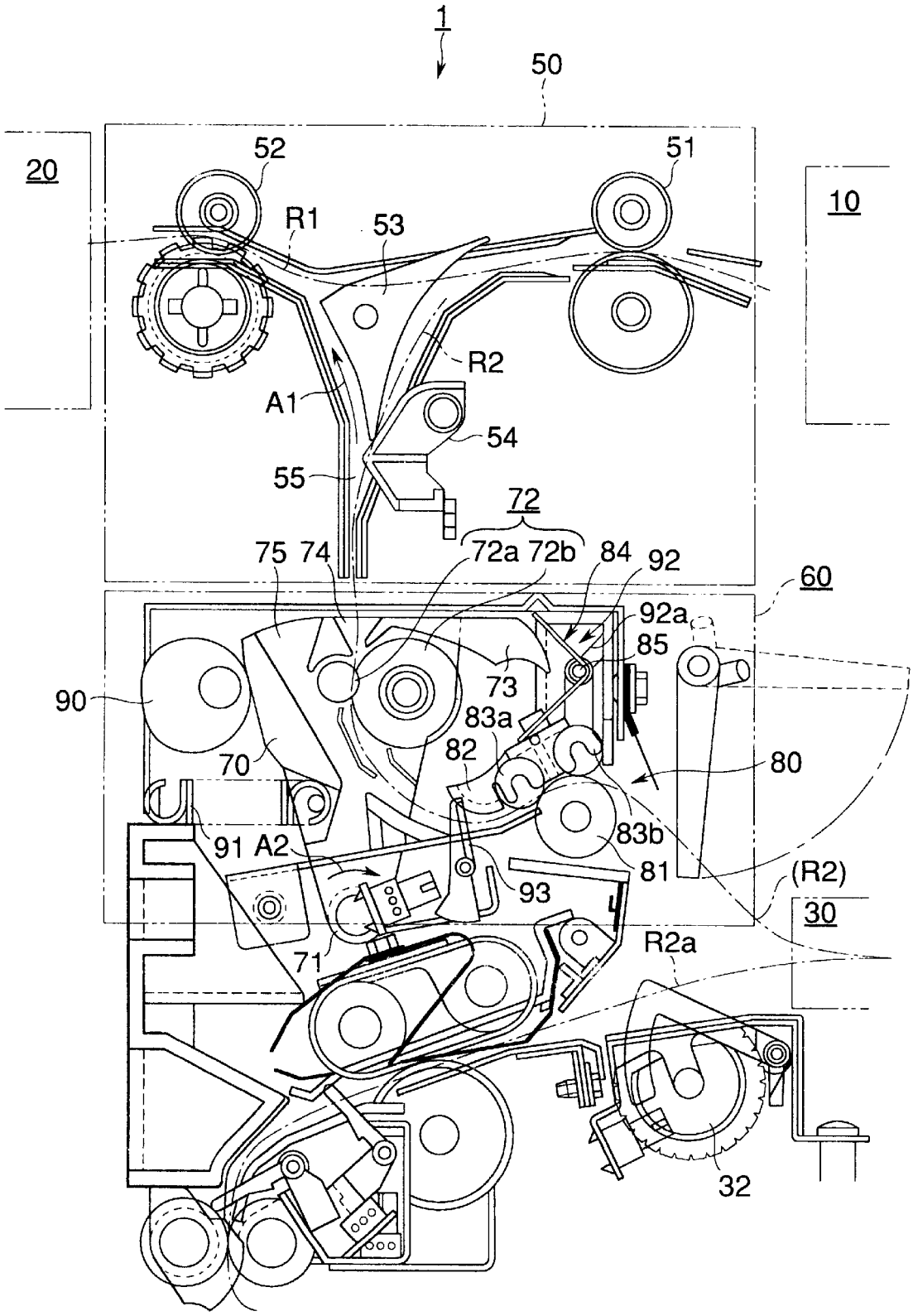
FIG. 1 is a sectional view showing a main part of an image forming apparatus according to a first embodiment of the present invention.
Figure 2:
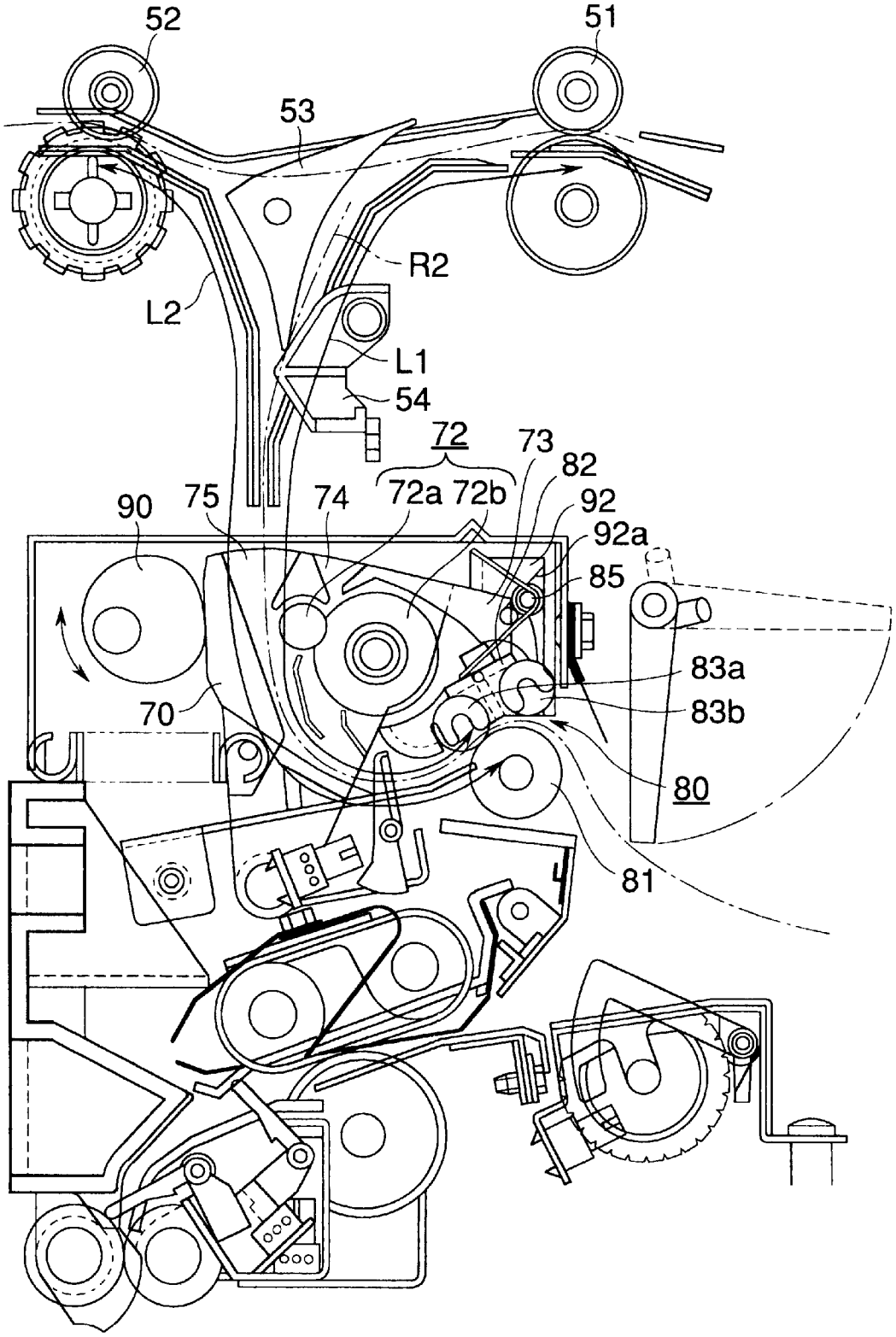
FIG. 2 is a sectional view similar to FIG. 1, but showing a condition that a first pair of curl removing rollers are retarded.
Figure 5:
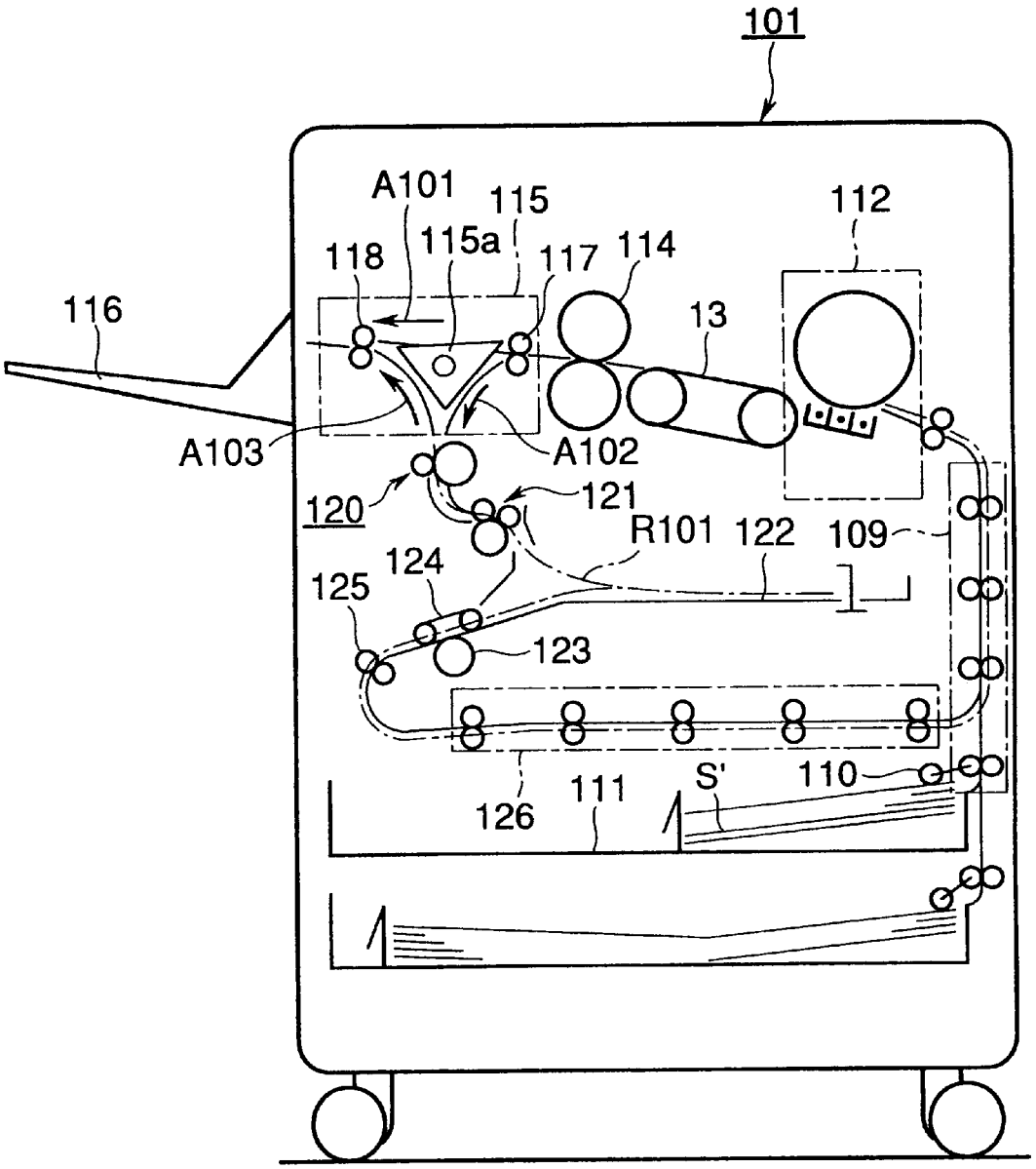
FIG.5 PRIOR ART
FIG. 5 is a schematic sectional view of a conventional copying machine as an image forming apparatus.
Figure 6:
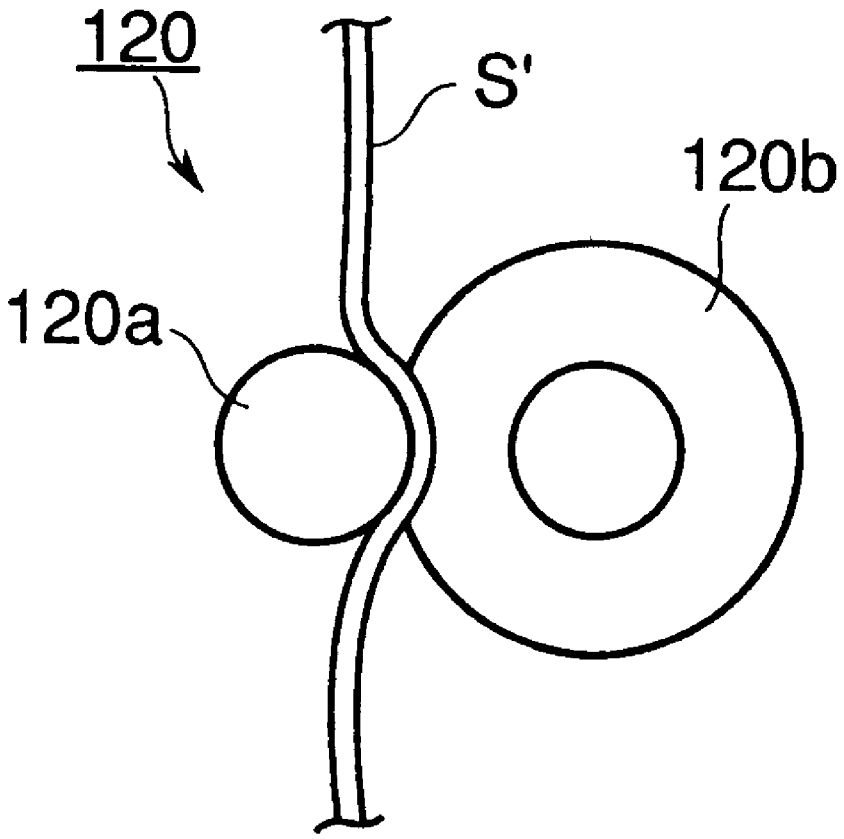
FIG.6 PRIOR ART
FIG. 6 is a view showing a first conventional curl removing means.
Figure 7:
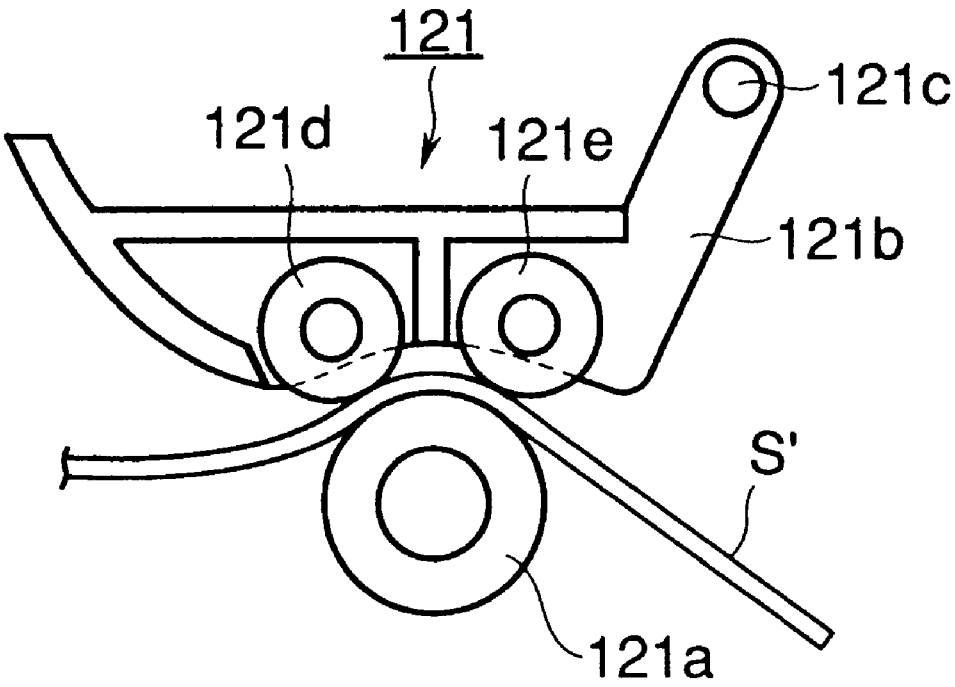
FIG.7 PRIOR ART
FIG. 7 is a view showing a second conventional curl removing means.

FIGS. 1 and 2 are sectional views showing characteristic parts of a copying machine 1 (as an image forming apparatus) according to a first embodiment of the present invention. FIGS. 1 and 2 show mechanisms corresponding to the surface-reverse/discharge portion 115 and the first and second curl removing means 120, 121 shown in FIG. 5, the other arrangements of the copying machine 1 other than those shown in FIGS. 1 and 2 are the same as those of the copying machine shown in FIG. 5.

A surface-reverse/discharge portion 50 as a branch portion provided in the course of a convey path R1 for conveying the sheet material S from an image forming portion 10 (disposed at the right in FIG. 1) to a discharge portion 20 (disposed at the left in FIG. 1) of the copying machine 1 includes a pair of inner discharge rollers 51, a pair of outer discharge rollers 52, a first flapper (switching means) 53 and a second flapper 54. The sheet material S sent from the image forming portion 10 is introduced into a re-supply convey path R2 along a right (in FIG. 1) lower surface of the first flapper 53 to reach a curl removing portion 60 for removing curl in the sheet material S entered into the re-supply convey path R2.

The sheet material S passed through the curl removing portion 60 is temporarily rested on an intermediate tray 30. The sheet materials S stacked on the intermediate tray 30 are separated one by one by means of a pick-up roller 32 and a tractor separation device 33, and the separated sheet material is conveyed through a re-supply convey path R2*a* disposed at a downstream side of the intermediate tray 30 to be re-supplied to the image forming portion 10, where an image is formed on the other surface (rear surface) of the sheet material.

The curl removing portion 60 comprises a curl removing unit 70 rotatably supported by a shaft 71. The curl removing unit 70 includes a first curl removing roller pair 72 comprised of an iron roller 72*a* and a sponge roller 72*b* which act as a convey means and a curl correcting means. The curl removing unit is biased toward a predetermined position by a spring 91 and can be rotated in a clockwise direction (FIG. 1) by a cam 90 so that the first curl removing roller pair 72 is retarded from the re-supply convey path R2.

At a downstream side of the curl removing unit 70, there is provided a second curl removing roller pair 80 comprised of a roller 81 and two sub-rollers 83*a*, 83*b* rotatably supported by a holder 82 and acting as a convey means and a curl correcting means. The holder 82 is pivotally mounted on a shaft 85 and is biased toward the roller 81 by a spring 84. The shaft 85 can be shifted rightwardly and upwardly along an elongated slot 92*a* formed in a guide member 92.

Next, an operation of the copying machine 1 having the above-mentioned construction will be explained.

(1) Both-face copy mode:

The sheet material sent from the image forming portion 10 is introduced into the re-supply convey path R2 along the right lower surface of the first flapper 53 and then is passed through the first and second curl removing roller pairs 72, 80 to remove the curl from the sheet material, as is in conventional copying machines. The sheet materials from which the curl is removed are stacked on the intermediate tray 30 in a condition that no curl exists in the sheet materials or small curl facing downwardly is formed in each sheet material.

Thereafter, each sheet material is conveyed by the re-supply means such as the pick-up roller 32 and the tractor separation device 33 from the intermediate tray 30 to the re-supply convey path R2*a* disposed at the downstream side of the intermediate tray to be re-supplied to the image forming portion 10, where an image is formed on a second surface (rear surface) of the sheet material. Then, the sheet material on both surfaces of which the images were formed is conveyed through the convey path R1 to be discharged to the discharge portion 20.

(2) Surface-reversing and discharging:

The copying machine 1 has a surface reversing function capable of discharging the sheet material on which the image was formed to the discharge portion 20 while surface-reversing the sheet material. The surface reversing function is required for discharging and arranging the sheet material in a copying sequence by surface-reversing the sheet material (on an upper surface of which the image was formed in the image forming portion 10) and then discharging the sheet material to the discharge portion 20.

To carry out this function, there is provided a surface-reversing and discharging means including the re-supply convey path R2 branched from the convey path R1, first and second flappers (switching means in the surface-reverse/discharge portion 50) 53, 54, first and second curl removing roller pairs 72, 80 capable of switching the conveying direction of the sheet material S in the curl removing portion 60, and a control means (not shown) for controlling these elements.

(a) When a sheet material Sa smaller than an A4 size sheet is surface-reversed and discharged:

When the sheet material is surface-reversed and discharged, as shown in FIG. 1, both the first and second curl removing roller pairs 72, 80 are not retarded from the re-supply convey path R2, and the sheet material is surface-reversed and discharged by using a sheet path as is in the conventional cases. That is to say, the sheet material Sa is conveyed from a first sheet path 74 of the curl removing unit 70 through a nip between the first pair of curl removing rollers 72 to a position 55 where the trail end of the sheet material has passed through the first and second flappers 53, 54. Then, the control means changes the conveying direction of the first and second curl removing roller pairs 72, 80 to convey the sheet material in a direction shown by the arrow A1 to return the sheet material to the convey path R1, thereby discharging the sheet material onto the discharge portion 20 while surface-reversing the sheet material Sa.

In this case, although the tip end of the sheet material Sa enters into the second curl removing roller pair 80, since the sheet material Sa has small size, a distance through which the sheet material is pinched by the first curl removing roller pair 72 and the second curl removing roller pair 80 becomes short, thereby preventing occurrence of the wrinkle in the sheet material.

(b) When a sheet material Sb equal to or greater than an A4 size sheet is surface-reversed and discharged:

For example, when a sheet Sb having A4 size is surface-reversed and discharged, if the sheet material Sb is conveyed in the normal direction and then in the reverse direction by the first and second curl removing roller pairs 72, 80 in the same manner as the sheet Sb smaller than the A4 size sheet, since a distance through which the sheet material Sb is pinched by the first and second curl removing roller pairs 72, 80 is long, the wrinkle is apt to be formed in the sheet material.

To avoid this, the control means rotates the curl removing unit 70 in a direction shown by the arrow A2 by 180 degrees via a half-revolution clutch (not shown) to bring the curl removing unit to a condition shown in FIG. 2.

In the condition shown in FIG. 2, due to the rotation of the curl removing unit 70, the first sheet path 74 and the first curl removing roller pair 72 are retarded from the re-supply convey path R2, and a second sheet path 75 is aligned with the re-supply convey path R2.

Further, the shaft 85 is lifted along the elongated slot 92*a* of the guide member 92 by a pawl 73 provided at a right end portion of the curl removing unit 70, with the result that the right sub-roller 83*b* is separated from the roller 81. In this case, it is selected so that a distance L1 between the left sub-roller 83*a* (contacted with the roller 81) and the pair of inner discharge rollers 51 and a distance L2 between the sub-roller 83*a* and the pair of outer discharge rollers 52 becomes slightly smaller than a length of the A4 size sheet material in the conveying direction (210 mm).

Immediately after a trail end Sb2 of the sheet material Sa entered into the re-supply convey path R2 from the convey path R1 passes through between the first and second flappers 53 and 54, the trail end is detected by a sensor (not shown), with the result that the control means of the surface-reversing and discharging means starts the reverse rotations of the roller 81 and the sub-rollers 83 of the second curl removing roller pair 80, thereby changing the advancing direction of the sheet material Sb.

Figure 3:
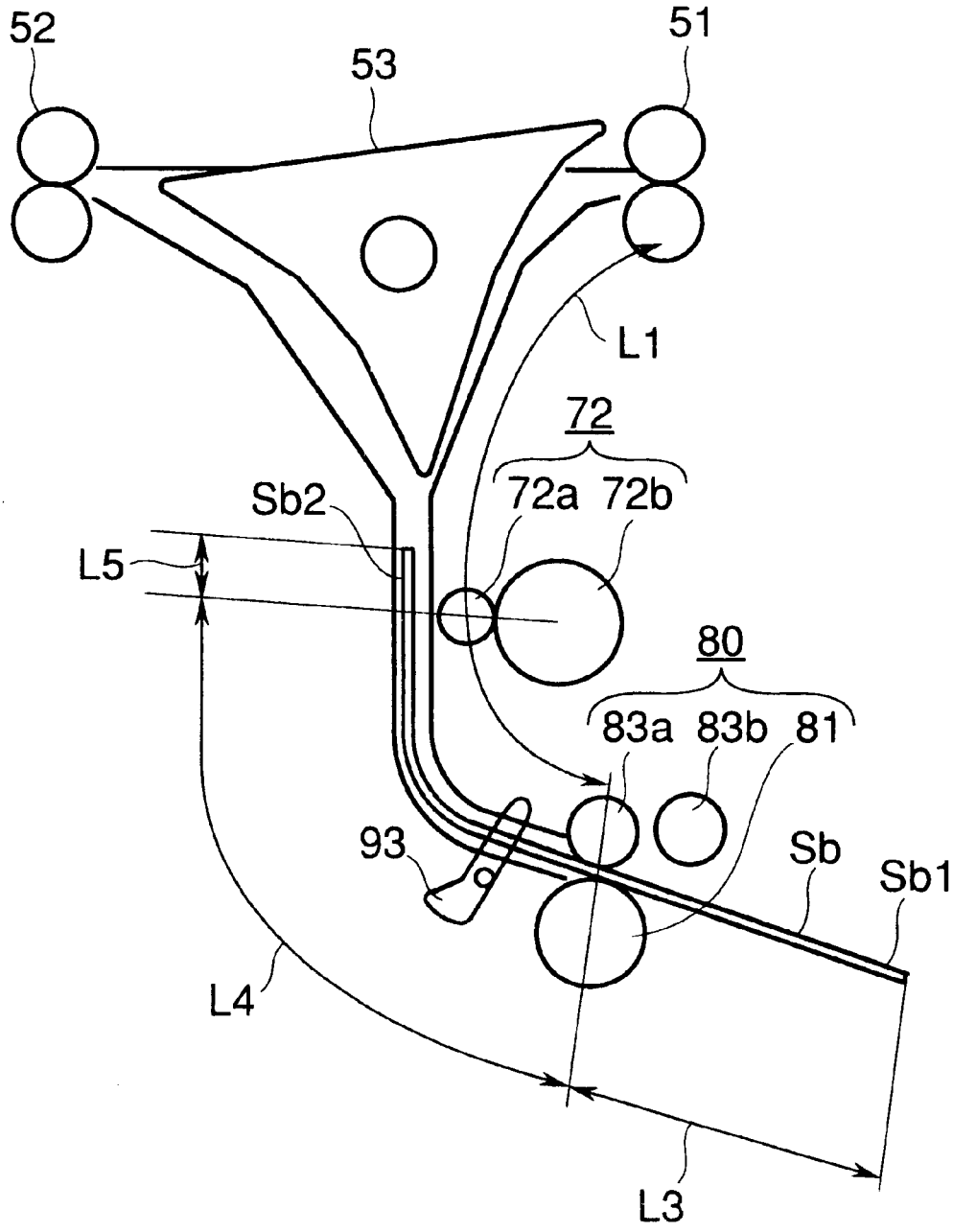
FIG. 3 is an explanatory view for explaining surface-reversing and conveying operations for a sheet material.
Figure 8:
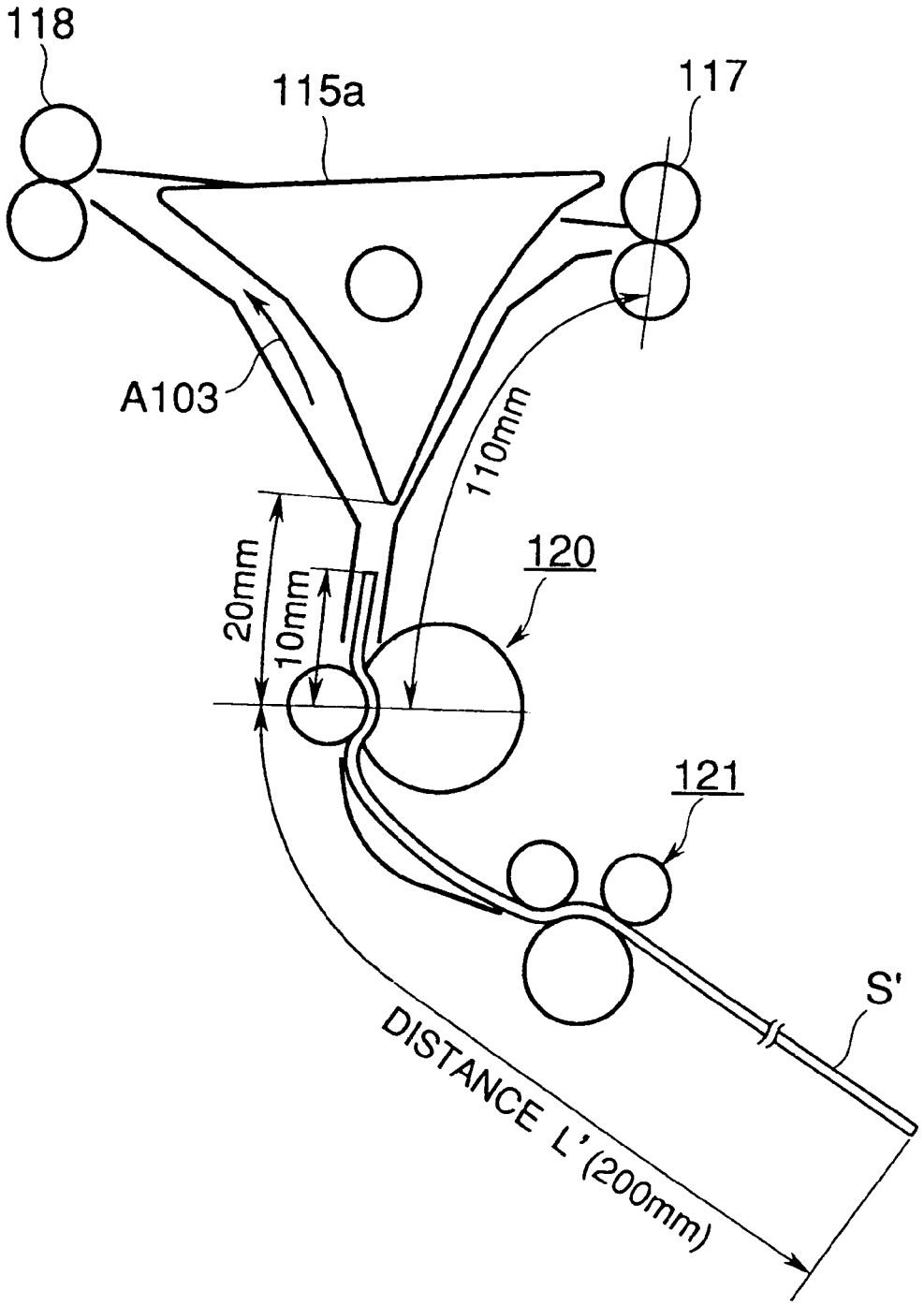
FIG.8 PRIOR ART
FIG. 8 is a view for explaining surface-reversing and conveying operations for a sheet material in a conventional technique.

In this case, as shown in FIG. 3, a distance L3 between the convey means which is not retarded and which is used for effecting the surface-reversing (second pair of curl removing rollers 80, in this case) and the trail end of the sheet material Sb becomes 110 mm, which is greatly reduced in comparison with the distance L' (=200 mm) in the conventional case shown in FIG. 8.

Incidentally, the positions of the first and second curl removing roller pairs 72, 80 are the same as those in the conventional case shown in FIG. 8, so that the distance L1 is 200 mm, a distance L4 between the first curl removing roller pair 72 and the second curl removing roller pair 80 is 90 mm, and a distance L5 between the first curl removing roller pair 72 and the trail end Sb2 of the sheet material Sb is 10 mm.

Due to the reverse rotation of the second curl removing roller pair 80, when a tip end Sb1 of the sheet material Sb leaves the second curl removing roller pair 80, the tip end Sb1 is detected by a sensor 93. As a result, the second curl removing roller pair 80 is rotated in the normal direction again.

By selecting a sheet-to-sheet distance so that a second sheet material Sc reaches the second curl removing roller pair 80 as soon as the second curl removing roller pair 80 is rotated in the normal direction again, the first sheet material Sb is overlapped with the second sheet material Sc at a position where the first curl removing roller pair 72 is retarded. In this way, the sheet-to-sheet distance can be reduced, thereby improving the productivity.

Incidentally, the first sheet material Sb previously surface-reversed is discharged onto the discharge portion 20 while being pinched by the pair of outer discharge rollers 52.

Figure 4A:
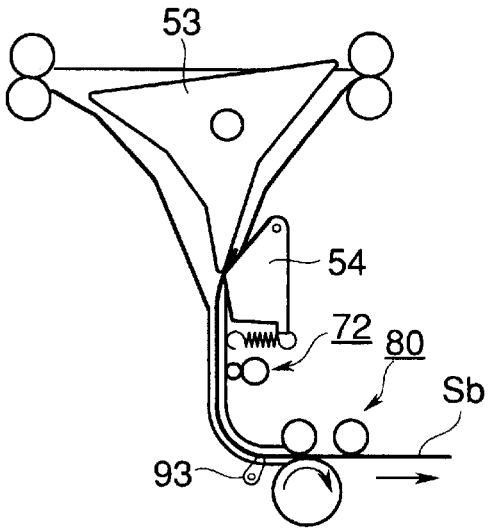
FIGS. 4A, 4B, 4C and 4D are explanatory views for explaining surface-reversing and conveying operations for a sheet material.
Figure 4B:
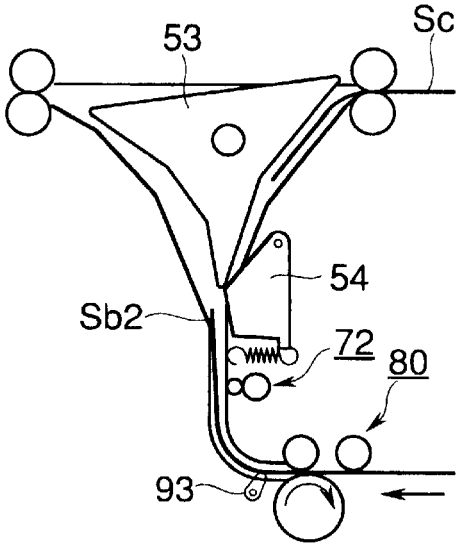
Figure 4C:
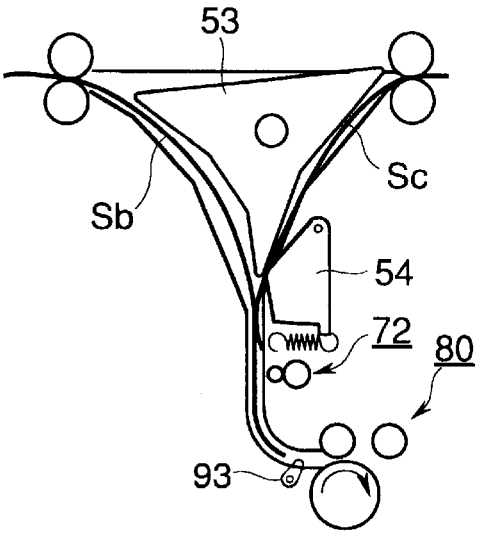
Figure 4D:
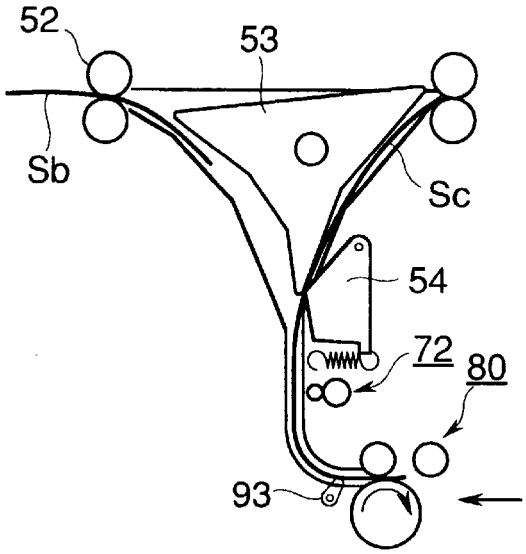

Explaining the above-mentioned operation with reference to FIGS. 4A to 4D, first of all, the first sheet material Sb is introduced into the re-supply convey path R2 (FIG. 4A). After the trail end Sb2 of the sheet material leaves the first flapper 53, the second curl removing roller pair 80 is stopped and then is rotated in the reverse direction (FIG. 4B). Then, the second sheet material Sc is introduced into the re-supply convey path R2 at a timing that the second sheet material Sc is overlapped with the first sheet material Sb at the position where the first curl removing roller pair 72 is retarded (FIG. 4C). In this case, when the tip end Sb1 of the first sheet material Sb leaves the second curl removing roller pair 80 to turn the sensor 93 OFF, the second curl removing roller pair 80 is rotated in the normal direction. In FIG. 4D, the second sheet material Sc enters into the second curl removing roller pair 80 and the first sheet material Sb is discharged onto the discharge portion 20 while being pinched by the pair of outer discharge rollers 52.

Accordingly, during the surface reversing operation, since the first sheet material Sb is not contacted with the first curl removing roller pair 72 and the sub-roller 83*b* of the second curl removing roller pair 80 is separated from the roller 81, the stress acting on the sheet material Sb can be reduced greatly. Further, during the surface reversing operation, since the distance L3 through which the sheet material Sb is pinched can be greatly reduced in comparison with the distance L' in the conventional copying machine, the wrinkle can be prevented from being formed in the thin sheet material or the large sized sheet material. In addition, the sheet-to-sheet distance (when the sheet materials are successively surface-reversed) can be reduced, thereby increasing the number of sheet materials discharged per unit time, and, thus, improving the productivity.

In the illustrated embodiment, while an example that two convey means (first curl removing roller pair 72 and second curl removing roller pair 80) are provided in the curl removing portion 60 disposed in the re-supply convey path R2 was explained, three or more convey means may be provided. When a number of convey means are provided, as the length of the sheet material (to be conveyed) in the conveying direction is increased, by retarding the convey means successively from an upstream one in the re-supply convey path R2, the present invention can be carried out.

(Second Embodiment)

In the first embodiment, while an example that the conveying speed of the second curl removing roller pair 80 in the normal direction is selected to be the same as the conveying speed thereof in the reverse direction was explained, in a second embodiment of the present invention, the conveying speed of the second curl removing roller pair

80 in the reverse direction is selected to become faster than the conveying speed of the second curl removing roller pair 80 in the normal direction.

Accordingly, the sheet material Sb is introduced into the re-supply convey path R2 at a conveying speed Va of the inner discharge roller pair 51 and then is conveyed in the direction at a conveying speed Vb of the second curl removing roller pair 80 equal to or slightly faster than the conveying speed Va. During the surface-reversing operation, the sheet material Sb is conveyed in the reverse direction at a conveying speed Vc faster than the conveying speed Vb. Incidentally, a conveying speed Vd of the outer discharge roller pair 52 may be equal to or slightly faster than the conveying speed Vc. Thus, a relation between the conveying speeds becomes $Va \leqq Vb < Vc \leqq Vd$.

With this arrangement, a time period during which the sheet material Sb is pinched by the second curl removing roller pair 80 can be reduced to permit the setting of shorter sheet-to-sheet distance, thereby improving the productivity of the copying machine 1.

Incidentally, in the illustrated embodiments, while an example that the first curl removing roller pair 72 is retarded from the re-supply convey path R2 by shifting the entire first curl removing roller pair 72 was explained, the first curl removing roller pair 72 may be retarded so that the sheet material is not pinched by the first curl removing roller pair 72 by greatly separating the rollers 72*a*, 72*b* of the first curl removing roller pair 72 from each other.

The present invention has the above-mentioned arrangement and function. Thus, by successively retarding the convey means from the re-supply convey path in dependence upon the length of the sheet (to be surface-reversed) in the conveying direction, since the sheet material is conveyed by the convey means which is (are) not retarded, excessive curl or wrinkle is not formed in the sheet material, thereby preventing the deterioration of the sheet material.

By introducing the succeeding sheet material into the re-supply convey path at the timing that the succeeding sheet material is overlapped with the preceding sheet material at the position where the convey means is retarded, the sheet-to-sheet distance can be reduced, thereby increasing the number of sheet materials discharged per unit time, and, thus, improving the productivity of the image forming apparatus.

By selecting the conveying speed of the convey means in the reverse direction to become faster than the conveying speed of the convey means in the normal direction, the number of sheet materials discharged per unit time can be increased.

The curl correcting (removing) means serve to correct the curl formed in the sheet material in the image forming portion in front of the re-supply convey path and/or in the convey path. When the sheet material is surface-reversed, since the sheet material is conveyed by engaging with only the curl correcting means which are not retarded from the re-supply convey path, unwanted curl correction and generation of the wrinkle can be prevented, thereby maintaining the quality of the sheet material.

By providing the curl correction amount changing means for changing the curling amount of the curl correcting means of the convey means which are not retarded, in synchronous with the retarding movement of the convey means which are retarded, the curl correction amount of the sheet material conveyed by the convey means which are not retarded is changed to maintain the quality of the sheet material.

In the above-mentioned embodiments, the size of the sheet material is detected by a sheet size detection means (not shown), and the control means retards the convey means (curl correcting means) on the basis of the detected size of the sheet material.

In the above-mentioned embodiments, while an example that the rollers of the first curl removing roller pair 72 are retarded in the same direction while forming the nip between these rollers was explained, the present invention is not limited to such an example, but, at least one of the iron roller 71*a* and the sponge roller 72*b* may be retarded to be separated from the other.

Alternatively, pressure of nip between the rollers of the first curl removing roller pair 72 may be reduced to an extent that the curl removing or correcting effect is disappeared.

What is claimed is:

1. An image forming apparatus comprising:

an image forming portion for forming an image on a sheet;

a convey path for conveying the sheet conveyed from said image forming portion to a discharge portion;

a re-supply convey path branched from a branch portion provided in said convey path and adapted to supply the sheet to said image forming portion again;

a switching means disposed at said branch portion and adapted to switch a path through which the sheet is conveyed to said convey path or said re-supply convey path;

a plurality of convey means provided at a plurality of positions in said re-supply convey path;

a surface-reversing and discharging means for returning the sheet entered into said re-supply convey path to said convey path by switching conveying direction of said convey means and for discharging the sheet from said discharge portion through said convey path while surface-reversing the sheet;

characterized in that some of said plurality of convey means can be retracted from said re-supply convey path to positions where the retracted convey means do not convey the sheet, and that said surface-reversing and discharging means causes said convey means to retract from said re-supply convey path in accordance with a length of the sheet to be surface-reversed in a conveying direction.

2. An image forming apparatus according to claim 1, wherein said surface-reversing and discharging means causes said convey means to retract successively from an upstream one in accordance with the length of the sheet to be surface-reversed, and a next sheet is entered into said re-supply convey path at a timing that the next sheet is overlapped with the sheet to be conveyed in a reverse direction through said re-supply convey path, at a position where the last convey means is retracted.

3. An image forming apparatus according to claim 1, wherein said surface-reversing and discharging means makes a conveying speed of said convey means faster in the reverse direction than in the normal direction.

4. An image forming apparatus according to claim 2, wherein said surface-reversing and discharging means makes a conveying speed of said convey means faster in the reverse direction than in the normal direction.

5. An image forming apparatus according to one of claims 1 to 4, wherein said convey means includes a curl correcting means for correcting curl in the sheet being conveyed by pinching and conveying the sheet.

6. An image forming apparatus according to claim 5, further comprising a curl correction amount changing means for changing a curling amount of said curl correcting means of said convey means which are not retracted, in synchronous with the retracting movement of said convey means which are retracted.

7. An image forming apparatus according to claim 6, wherein each of said convey means which are not retracted includes a single roller and two sub-rollers urged against said roller at different positions along a circumferential direction so that the curl can be corrected by passing the sheet through nips between said roller and said sub-rollers, and said curl correcting means can separate at least one of said sub-rollers from said roller.

8. An image forming apparatus comprising:

an image forming means for forming an image on a sheet;

a discharge means for discharging the sheet on which the image was formed by said image forming means;

a re-supply path for guiding the sheet on which the image was formed by said image forming means to said image forming means again;

a switching means for selectively directing the sheet on which the image was formed by said image forming means to said discharge means or said re-supply path and for directing the sheet from said re-supply path to said discharge means;

a plurality of convey means provided at a plurality of positions in said re-supply path and adapted to convey the sheet along said re-supply path in a direction directing from said switching means toward said image forming means or in an opposite direction;

a retracting means for retracting some of said convey means from said re-supply path to positions where the retracted convey means do not convey the sheet; and a control means for controlling said convey means to convey the sheet directed into said re-supply path by said switching means along said re-supply path in the direction directing from said switching means toward said image forming means and to convey the sheet in the opposite direction after a trail end of the sheet passes through said switching means and for controlling said retracting means in accordance with a length of the sheet in a conveying direction.

9. An image forming apparatus according to claim 8, wherein said control means does not operate said retracting means when a sheet having a first length is conveyed and controls said retracting means to retract the some of said convey means from said re-supply path when a sheet having a second length is conveyed.

10. An image forming apparatus according to claim 8, further comprising a size detection means for detecting a size of the sheet, and wherein said control means controls said retracting means on the basis of a detection result of said size detection means.

11. An image forming apparatus according to claim 8, further comprising a first convey means for conveying the sheet on which the image was formed by said image forming means directly to said switching means, and wherein, when the convey means disposed in said re-supply path immediately at a downstream side of said switching means is regarded as a second convey means and the convey means disposed in said re-supply path immediately at a downstream side of said second convey means is regarded as a third convey means, said second convey means is retracted when a sheet having a length grater than a distance of a convey path from said first convey means to said third convey means.

12. An image forming apparatus according to claim 8, wherein the convey means retracted by said retracting means corrects the curl in the sheet while conveying the sheet.

13. An image forming apparatus comprising:

an image forming means for forming an image on a sheet;

a discharge means for discharging the sheet on which the image was formed by said image forming means;

a re-supply path for guiding the sheet on which the image was formed by said image forming means to said image forming means again;

a switching means for selectively directing the sheet on which the image was formed by said image forming means to said discharge means or said re-supply path and for directing the sheet from said re-supply path to said discharge means;

a plurality of convey means provided at a plurality of positions in said re-supply path and adapted to convey the sheet along said re-supply path in a direction directing from said switching means toward said image forming means or in an opposite direction, a most upstream one of said convey means acting as a curl correcting means for correcting curl in the sheet while conveying the sheet;

a means for weakening a curl correcting ability of said curl correcting means; and a control means for controlling said convey means to convey the sheet directed into said re-supply path by said switching means along said re-supply path in the direction directing from said switching means toward said image forming means and to convey the sheet in the opposite direction after a trail end of the sheet passes through said switching means and for weakening the curl correcting ability in accordance with a length of the sheet in a conveying direction.

14. An image forming apparatus according to claim 13, further comprising first convey means for conveying the sheet on which the image was formed by said image forming means directly to said switching means, and wherein said curl correcting means is regarded as second conveying means, the conveying means disposed in said re-supply path immediately at a downstream side of said second conveying mean is regarded as third conveying means, and said control means weakens a curl correcting ability of said second conveying means when a sheet having a length greater than a distance of a convey path from said first conveying means to said third conveying means is conveyed.

15. An image forming apparatus according to claim correcting ability of said curl correcting means when a sheet having a first length is conveyed, and said control means weakens a curl correcting ability of said curl correcting means when a sheet having a second length is conveyed.

16. An image forming apparatus including:

image forming means for forming an image on a sheet;

discharging means for discharging the sheet on which the image is formed by said image forming means;

a re-supply path for guiding the sheet on which the image is formed by said image forming means to said image forming means again;

switching means for selectively directing the sheet on whcih the image is formed by said image forming means to said discharging means and to said re-supply path, and for directing the sheet from said re-supply path to said discharging means;

conveying means provided in a plurality of positions on said re-supply path, for conveying the sheet along said re-supply path in a direction from said switching means toward said image forming means and in an opposite direction;

moving means for moving a part of said conveying means between a first state in which the sheet is conveyed and a second state in which the sheet is not conveyed; and control means for controlling said conveying means so that the sheet directed to said re-supply path by said switching means is conveyed along said re-supply path in said direction from said switching means toward said image forming means and the sheet is conveyed in said opposite direction after a trailing end of the sheet passes through said switching means, and for controlling said moving means in accordance with a length of the sheet in a conveying direction.

17. An image forming apparatus according to claim 16, wherein said control means controls said moving means so that when a sheet having a first length is conveyed, said a sheet having a second length greater than said first length is conveyed, said part of said conveying means is moved into said second state.

18. An image forming apparatus accoring to claim 16, further including size detection means for detecting a size of the sheet, and wherein said control means controls said moving means based on a detection of said size detection means.

19. An image forming apparatus according to claim 16, further including first conveying means for conveying the sheet on which the image is formed by said image forming means directly to said switching means, and wherein said part, which is adjacent to a downstream side of said swiching means, of said conveying means on said re-supply path is regarded as second conveying means, and a further part, which is adjacent to a downstream side of said part, of side conveying means is regarded as third conveying means, and wherein when a sheet having a conveying direction length greater than a distance of a convey path from said first conveying means to said third conveying means is conveyed, said second conveying means is moved into said second state.

20. An image forming apparatus according to claim 16, wherein said pat of said conveying means movable inoto said second state by said moving means corrects a curl of the sheet while conveying the sheet when said part of said conveying means is said first state.

21. An image forming apparatus according to claim 19, wherein said second conveying means corrects a curl of the sheet when said second conveying means is in said first state.

* * * * *

UNITED STATES PATENT AND TRADEMARK OFFICE

CERTIFICATE OF CORRECTION

PATENT NO. : 6,094,561
DATED : July 25, 2000
INVENTOR(S) : Kenji Ushio

It is certified that error appears in the above-identified patent and that said Letters Patent is hereby corrected as shown below:

Title page,
Item No. [30]: Foreign Application Priority Data: "Nov. 9, 1996" should read -- Nov. 6, 1996 --.

Signed and Sealed this

Ninth Day of October, 2001

*Attest:*

Nicholas P. Godici

*Attesting Officer*

NICHOLAS P. GODICI
*Acting Director of the United States Patent and Trademark Office*